US008721361B2

(12) United States Patent
Wu

(10) Patent No.: US 8,721,361 B2
(45) **Date of Patent: *May 13, 2014**

(54) LOW PROFILE CABLE CONNECTOR ASSEMBLY

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 274 days.

This patent is subject to a terminal disclaimer.

(21) Appl. No.: 13/089,332

(22) Filed: Apr. 19, 2011

(65) Prior Publication Data

US 2011/0256764 A1 Oct. 20, 2011

(30) Foreign Application Priority Data

Apr. 19, 2010 (CN) ..... 2010 2 0162732 U

(51) Int. Cl.
*H01R 12/24* (2006.01)

(52) U.S. Cl.
USPC ..... 439/497; 439/607.49; 439/907

(58) Field of Classification Search
USPC ..... 439/660, 497, 579, 607.49, 907
See application file for complete search history.

(56) References Cited

U.S. PATENT DOCUMENTS

| | | | | |
|---|---|---|---|---|
| 4,157,612 | A * | 6/1979 | Rainal | 29/828 |
| 4,406,512 | A * | 9/1983 | Schell | 439/497 |
| 4,453,798 | A * | 6/1984 | Asick et al. | 439/581 |
| 6,793,527 | B2 * | 9/2004 | Noro | 439/579 |
| 6,830,478 | B1 * | 12/2004 | Ko | 439/579 |
| 6,953,367 | B2 * | 10/2005 | Ji et al. | 439/660 |
| 7,134,884 | B2 * | 11/2006 | Wang et al. | 439/76.1 |
| 7,165,998 | B2 * | 1/2007 | Lee et al. | 439/660 |
| 7,402,084 | B2 * | 7/2008 | Wu | 439/660 |
| 7,422,488 | B1 * | 9/2008 | Wu | 439/676 |
| 7,462,071 | B1 * | 12/2008 | Wu | 439/607.05 |
| 7,470,150 | B2 * | 12/2008 | Kuo et al. | 439/607.41 |
| 7,534,141 | B1 * | 5/2009 | Wu | 439/607.01 |
| 7,540,785 | B1 * | 6/2009 | Zhao | 439/660 |
| 7,563,140 | B1 * | 7/2009 | Wan et al. | 439/660 |
| 7,578,705 | B2 * | 8/2009 | He et al. | 439/660 |
| 7,625,243 | B2 * | 12/2009 | Chen et al. | 439/660 |
| 7,717,733 | B1 * | 5/2010 | Yi et al. | 439/452 |
| 7,850,465 | B1 * | 12/2010 | Wan et al. | 439/79 |
| 7,862,346 | B1 * | 1/2011 | Wan et al. | 439/79 |
| 7,872,873 | B2 * | 1/2011 | Hiew et al. | 361/737 |
| 7,878,850 | B2 * | 2/2011 | Wu | 439/579 |
| 7,883,364 | B2 * | 2/2011 | Wu | 439/578 |
| 7,896,559 | B2 * | 3/2011 | Yi et al. | 385/75 |
| 7,927,145 | B1 * | 4/2011 | Chang | 439/607.31 |

(Continued)

FOREIGN PATENT DOCUMENTS

| | | |
|---|---|---|
| TW | M357095 | 5/2009 |

*Primary Examiner* — Neil Abrams
(74) *Attorney, Agent, or Firm* — Wei Te Chung; Ming Chieh Chang

(57) ABSTRACT

A cable connector assembly (100), comprises: a plurality of first contacts (2), an insulative housing (1) molding outside the first contacts (2), a plurality of second contacts (3) received in the housing (1), a flat cable (4) connecting with the first contacts (2) and the second contacts (3), and the cable (4) comprising a plurality of inner conductors (40) arranged on upper and lower row, the upper row of the inner conductors (40) soldered to the second contacts (3) and the lower row of the inner conductors (40) soldered to the first contacts (2), a metallic shell (5) shielding outside the insulative housing (1). The two inner conductors (40) are soldered to a single power contact (21).

13 Claims, 9 Drawing Sheets

(56) References Cited

U.S. PATENT DOCUMENTS

| | | | | |
|---|---|---|---|---|
| 7,927,148 | B2 * | 4/2011 | Chang | 439/620.16 |
| 8,052,431 | B1 * | 11/2011 | He et al. | 439/78 |
| 8,052,477 | B1 * | 11/2011 | Ko | 439/660 |
| 8,079,854 | B2 * | 12/2011 | He et al. | 439/108 |
| 8,133,079 | B2 * | 3/2012 | He | 439/660 |
| 8,172,585 | B2 * | 5/2012 | Chiu et al. | 439/108 |
| 8,197,281 | B2 * | 6/2012 | Yang | 439/499 |
| 8,215,996 | B2 * | 7/2012 | Su et al. | 439/660 |
| 8,303,329 | B2 * | 11/2012 | Wu | 439/395 |
| 8,393,920 | B2 * | 3/2013 | Yu et al. | 439/660 |
| 8,398,427 | B2 * | 3/2013 | Wu | 439/497 |
| 8,403,698 | B2 * | 3/2013 | Su et al. | 439/455 |
| 8,460,035 | B2 * | 6/2013 | Ueda et al. | 439/660 |
| 2011/0244733 | A1 * | 10/2011 | Ueda et al. | 439/660 |
| 2011/0256761 | A1 * | 10/2011 | Wu | 439/580 |
| 2011/0256764 | A1 * | 10/2011 | Wu | 439/607.01 |
| 2012/0052731 | A1 * | 3/2012 | Hsiao et al. | 439/620.22 |
| 2012/0071022 | A1 * | 3/2012 | Su et al. | 439/449 |
| 2012/0077390 | A1 * | 3/2012 | Tsai | 439/660 |

* cited by examiner

LOW PROFILE CABLE CONNECTOR ASSEMBLY

1. FIELD OF THE INVENTION

The present invention generally relates to a cable connector assembly, and more particularly to a low profile cable connector assembly.

2. DESCRIPTION OF RELATED ART

Universal Serial Bus (USB) is a serial bus standard to the PC architecture with a focus on computer telephony interface, consumer and productivity applications. The interface design of USB is standardized by the USB Implementers Forum (USB-IF), an industry standardized organization founded by computer and communication companies. And USB cables used to connect peripherals such as mouse devices, keyboards, PDAs, gamepads and joysticks, scanners, digital cameras, printers, external storage, networking components, etc. For many devices such as scanners and digital cameras, USB has become the standard connection method.

Taiwan Patent Publication No. 357095 discloses a USB 3.0 connector assembly. The previous USB plug has a round cable and a metallic shell enclosing the cable, so the USB plug has a high profile. Thus, the tradition USB plug can not meet the miniaturization developing trend.

Correspondingly, it is desired to have a cable connector assembly with improved structure to address the problems stated above.

BRIEF SUMMARY OF THE INVENTION

Accordingly, an object of the present invention is to provide a cable connector assembly with low profile.

In order to achieve the above-mentioned object, A cable connector assembly, comprising: a plurality of first contacts, an insulative housing molding outside the first contacts, a plurality of second contacts received in the housing, a flat cable connecting with the first contacts and the second contacts, and the cable comprising a plurality of inner conductors arranged on upper and lower row, the upper row of the inner conductors soldered to the second contacts and the lower row of the inner conductors soldered to the first contacts, a metallic shell shielding outside the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
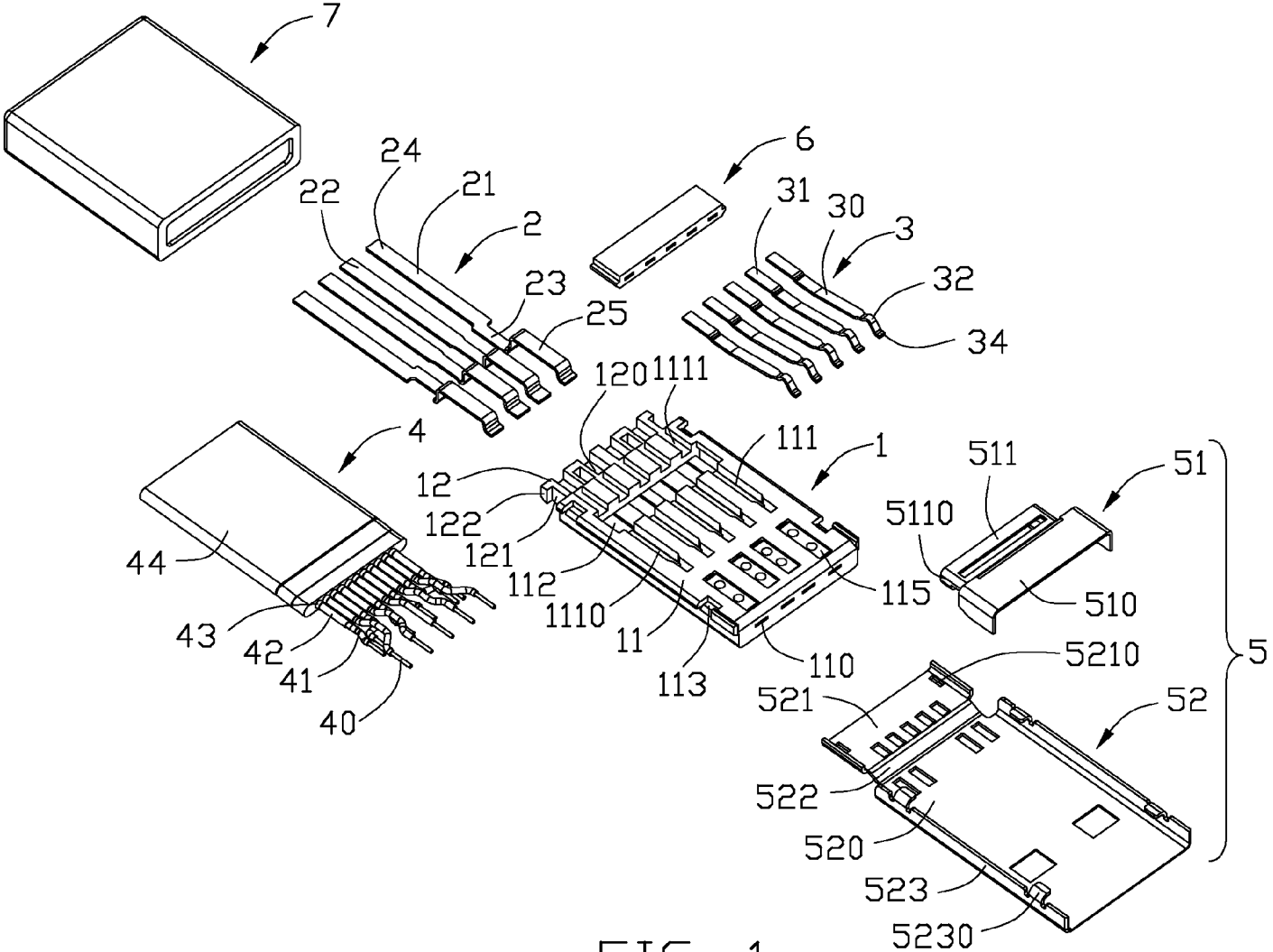
FIG. 1 is an exploded, perspective view of a cable connector assembly in accordance with the present invention.

Reference will now be made to the drawing figures to describe the present invention in detail.

Figure 2:
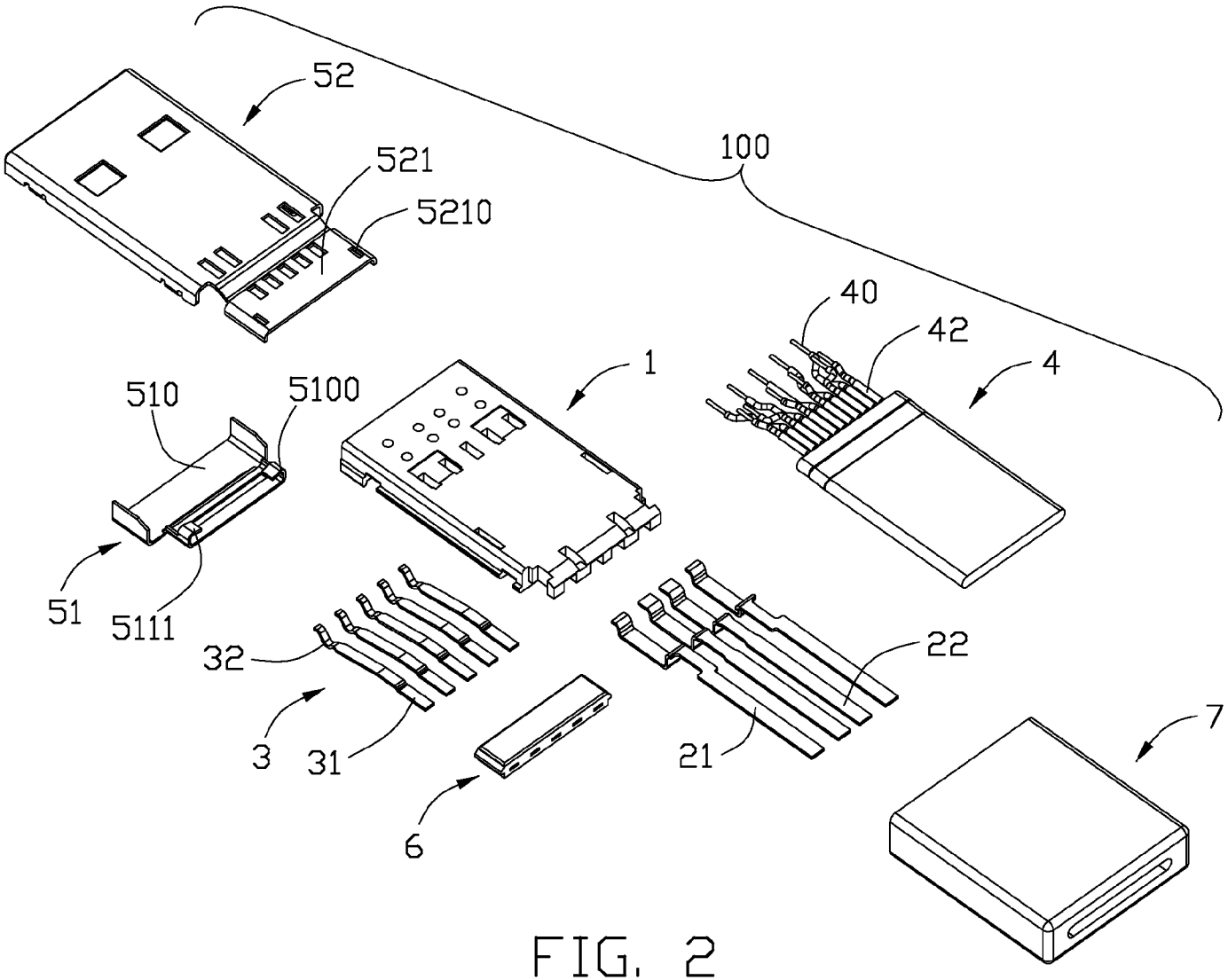
FIG. 2 is similar to FIG. 1, but viewed from another aspect.

Referring to FIGS. 1 to 2, a cable connector assembly 100 in accordance with the present invention is according with the USB 3.0 standard, and the cable connector assembly 100 comprises a plurality of first contacts 2, an insulative housing 1 molding outside the contacts 1, a plurality of second contacts 3 received in the insulative housing 1, cable 5 connecting with the first contacts 2 and the second contacts 3, and a metallic shell 5 shielding outside the insulative housing 1.

Referring to FIGS. 1 to 2, the insulative housing 1 comprise a base portion 11 and a tongue portion 12 extending rearwardly from the base portion 11. A plurality of terminal receiving passages 110 are defined in the base portion 11 and extend along a mating direction of the cable connector assembly 100. A plurality of terminal receiving grooves 111 formed in an upper surface of the base portion 11 for receiving the second contacts 3. A step-shaped portion 114 is formed in the lower section of the front surface of the terminal receiving grooves 111 and extended forwardly and downwardly. And in this way, the terminal receiving grooves 111 connecting with the terminal receiving passages 110 along the perpendicular direction. The transverse surface of the step-shaped portion 114 defines a bottom wall 1113. A groove 112 is recessed downwardly from the upper surface of the insulative housing 1 to divide the terminal receiving grooves 111 into a front section and a back section, and the front section defines a plurality of first receiving grooves 1110, and the back section defines a plurality of second receiving grooves 1111. A plurality of supporting grooves 120 formed in an upper surface of the tongue portion 12 and the supporting grooves 120 are respectively in alignment with the terminal receiving passages 110 along a front-to-back direction. Two rows of locking holes 113 are recessed downwardly from the two side walls of the upper surface of the base portion 11. A pair of bumps 122 are formed in the two lateral walls 121 of the tongue portion 12 and extending outwardly.

Referring to FIGS. 1 to 2, the number of the first contacts 2 is four, and two outside first contacts are defined as power contacts 21, and two inside first contacts are defined as signal contacts 22. Each contact 2 comprises a retention portion 23 and a tail portion 24 extending backwardly from the retention portion 20 and a mating portion 25 extending upwardly and forwardly from the retention portion 23. The tail portion 24 is beyond the back surface of the base portion 11 and the mating portion 25 is exposed on the upper surface of the insulative housing 1. The mating portions 25 are received in the terminal receiving passages 110 and the upper surface of the mating portions 25 are exposed in the grooves 115. The retention portions 23 are received in the terminal receiving passages 110, and the tail portions 24 are supported in the supporting grooves 120.

Referring to FIGS. 1 to 2, the number of the second contacts 3 are five, and each second contact 2 comprises a base portion 30, a tail portion 31 extending rearwardly from the base portion 30 and a mating portion 32 extending forwardly from the base portion 32. The mating portions 32 are exposed on the upper surface of the insulative housing 1, and the mating portions 32 are installed behind the mating portions 25. And a tail end 34 is formed in the end of the mating portion 32 and extending forwardly.

Referring to FIGS. 1 to 2, the cable connector assembly 100 also comprises a spacer 6 and the spacer 6 molding outside the back-section of the base portion 30 of the second contacts 3.

Figure 3:
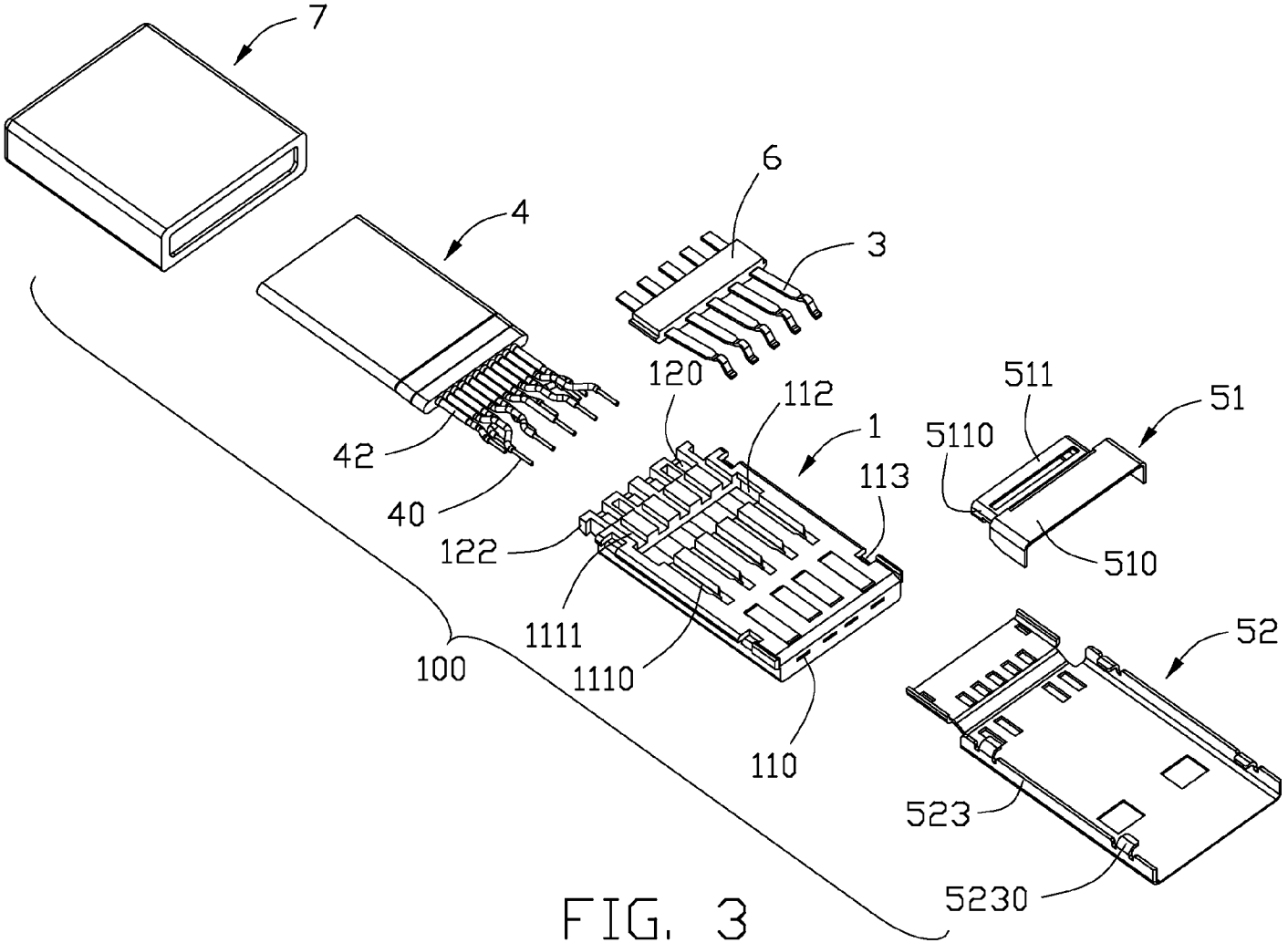
FIG. 3 is a perspective, partial assembled view of the cable connector assembly of FIG. 1.
Figure 4:
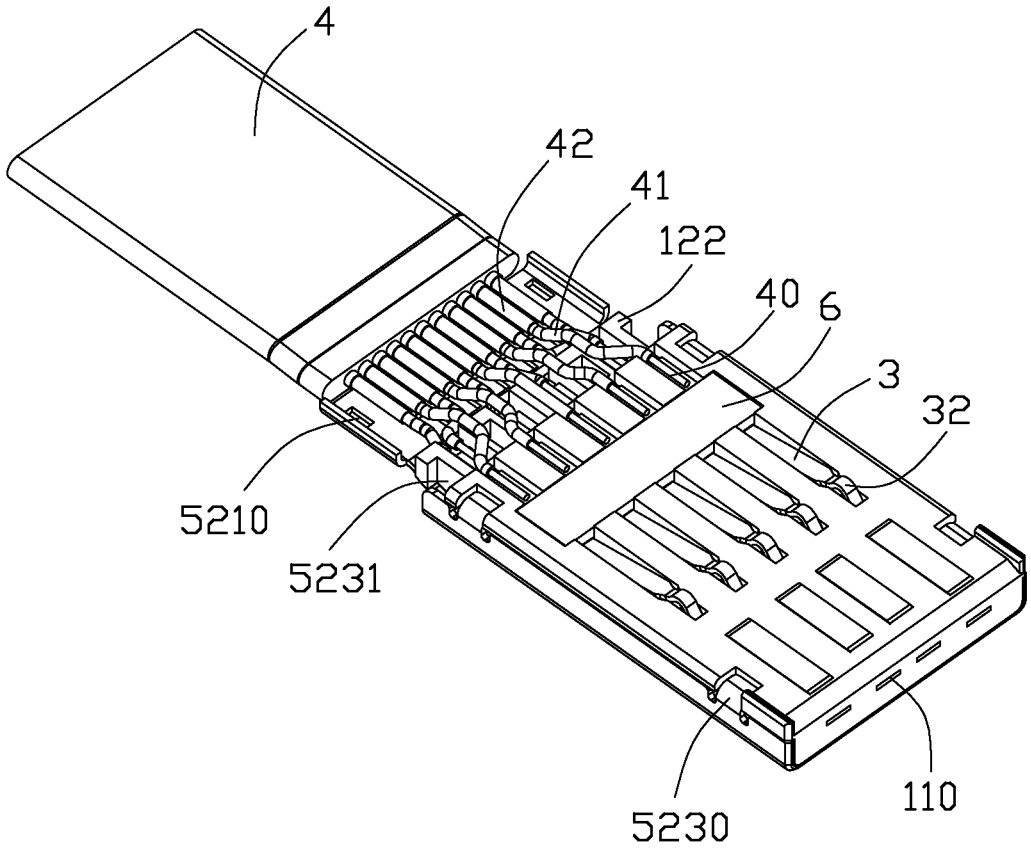
FIG. 4 is a perspective, partial assembled view of the electrical connector assembly when a top shell and a cover are removed.
Figure 5:
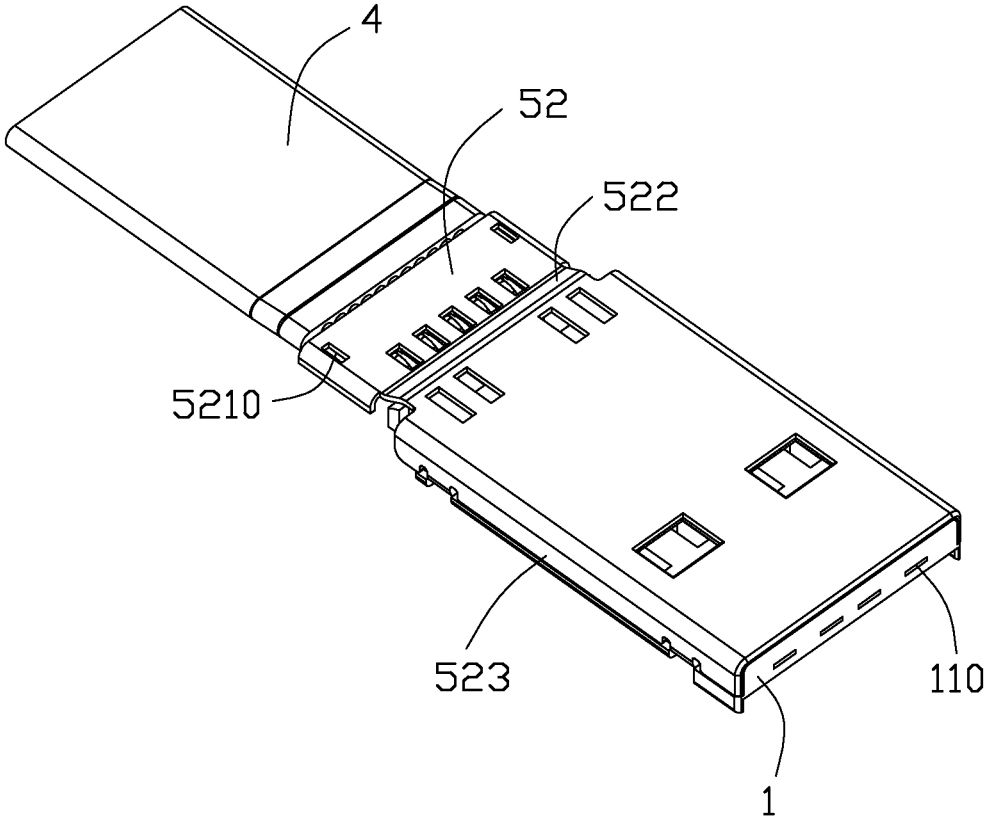
FIG. 5 is similar to FIG. 4, but viewed from another aspect.
Figure 6:
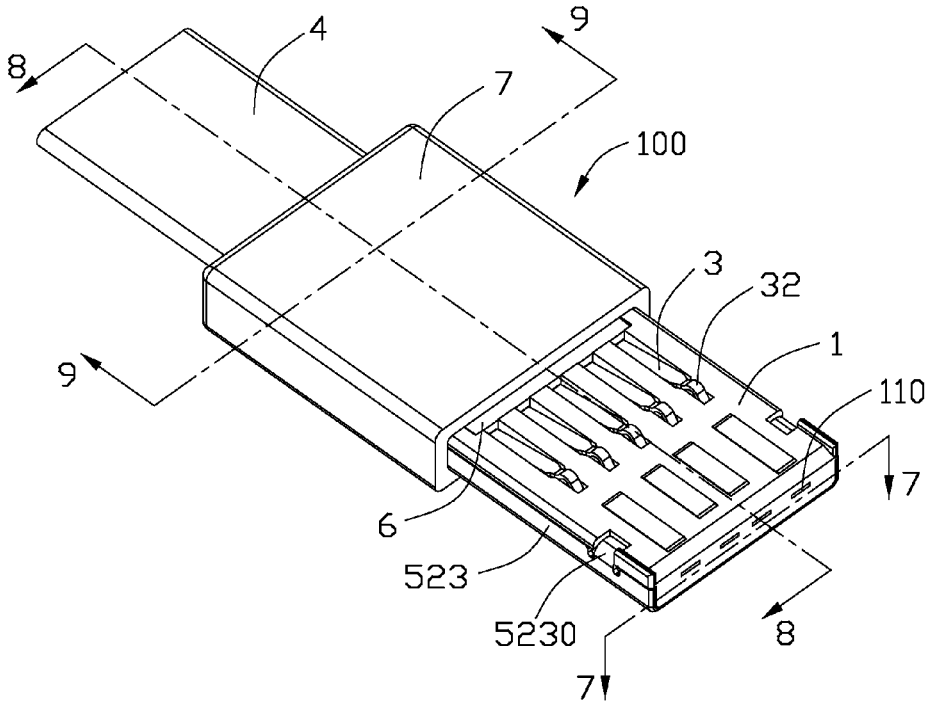
FIG. 6 is an assembled, perspective view of the cable connector assembly of FIG. 1.

Referring to FIGS. 1 to 2, the cable 4 comprises a plurality of wires, each wire comprises an inner conductor 40, an inner insulative layer 41 enclosing the inner conductor 40, a braiding layer 42 enclosing the inner insulative layer 41 and an outer insulative layer 43 enclosing the braiding layer 42. Besides, the cable 4 also comprises an insulative jacket 44 enclosing the wires. Please referring to FIGS. 1 to 2, the inner conductor 40 is exposed from the front edge of the inner insulative layer 41, the insulative layer 41 is exposed from the front edge of the braiding layer 42 and the braiding layer 42 is exposed from the front edge of the outer insulative layer 43, and all of the outer insulative layers 43 are exposed from the front edge of the insulative jacket 44 together. The cable connector assembly 100 of the present invention, the wires connecting with the first contacts 2 are departed from the wires connecting with the second contacts 3. The number of the inner conductors 40 connecting with the first contacts 2 is six and the inner conductors 40 arranged in a lower row. And the number of the inner conductors 40 connecting with the second contacts 3 is five and the inner conductors 40 arranged in an upper row. Please referring to the FIGS. 1 to 2 and in conjunction with FIGS. 3 to 4, the connecting method between the first contacts 2 and the second contacts 3 with the cable 4 of the present cable connector assembly 100 are as described: one of the upper row inner conductors 40 is connected with a second contact 3, the lateral two inner conductors 40 of the lower inner conductors 40 are connected with a power contact 21 at the same time, and one of the lower inner conductors 40 is connected with a signal contact 22.

Referring to FIGS. 1 to 2, the metallic shell comprises a top shell 51 and a bottom shell 52 assembled to each other along a vertical direction. The top shell 51 comprises a shielding portion 510 and a extending portion 511 extending rearwardly from the shielding portion 510. A pair of tabs 5111 are formed on the lateral walls 5110 of the extending portion 511 and extended inwardly from two lateral walls 5110. The bottom shell 52 comprises a shielding portion 520 enclosing the bottom surface of the insulative housing 1, a supporting portion 521 disposed behind the shielding portion 520 for supporting the braiding layer 42 and a connection 522 connecting the shielding portion 520 and the supporting portion 521 for supporting the tongue portion 12. A pair of locking tabs 5230 are formed on two lateral walls 523 of the bottom shell 52 for receiving into the locking holes 113. And a pair of holes 5210 are formed in the support portion 521 for locking with tabs 5111. The holes 5210 extending through out the upper surface and lower surface of the support portion 521.

Referring to FIG. 1 to 2 and in conjunction with FIG. 3 to 8, in assembled with the cable connector assembly 100, the contacts 2 are received in the insulative housing 1 via the insert-molding process, the contacts 2 are received in the terminal receiving passages 110 and the tail portion 22 of the contacts 2 are received in the terminal receiving grooves 120; and the spacer 6 molding outside the second contacts 3 and assembling onto the upper surface of the insulative housing 1, the mating portions 32 and the front edge of the base portions 30 are received in the first receiving grooves 1110, and the tail portions 31 of the second contacts 3 are received in the second receiving grooves 1111, and the tail ends 34 of the second contacts 3 are received into the front edge of the first receiving grooves 1110 and closed with the bottom surface of the bottom wall 1113; the spacer 6 is disposed in the grooves 112; then the bottom shell 52 is assembled in the bottom surface of the insulative housing 1, the locking tabs 5230 are received into the locking holes 113, and at the same time, the tongue portion 12 is supported on the connection portion 522, the lower row of the inner conductors 40 are disposed in the supporting grooves 120 and the upper row of the inner conductors 40 are disposed in the second receiving grooves 1111, and the braiding layers 42 are disposed on the supporting portion 521, then the upper row of the inner conductors 40 soldered to the second contacts 3, one conductor 40 is connected with a second contact 3, and the lower row of the inner conductors 40 soldered to the first contacts 2, two inner conductors 40 are connected with a power contact 21 and one inner conductor 40 is connected with a signal contact 22, and the braiding layers 42 soldered to the supporting portion 521, a pair of gaps 5231 are formed between the posts 122 and the lateral wall 523 behind the locking tabs 5230, then the top shell 51 is assembled to the bottom shell 52 along a vertical direction perpendicular to the mating portion, the tabs 5111 are locked into the holes 5210 and the lateral walls 5100 are disposed in the gaps 5231, the top shell 51 is only shielding outside the tongue portion 12 and the conjunction portion between the cable 4 and the first contacts 2, and the top shell 51 is assembled to the supporting portion 521 of the bottom shell 52, and the cover 7 is molded outside of the back of the insulative housing 1, the conjunction portion of the cable 4 and the first contacts 2 and the second contacts 3 and partial of the cable 4. Thus, the cable connector assembly 100 is assembled.

Figure 7:
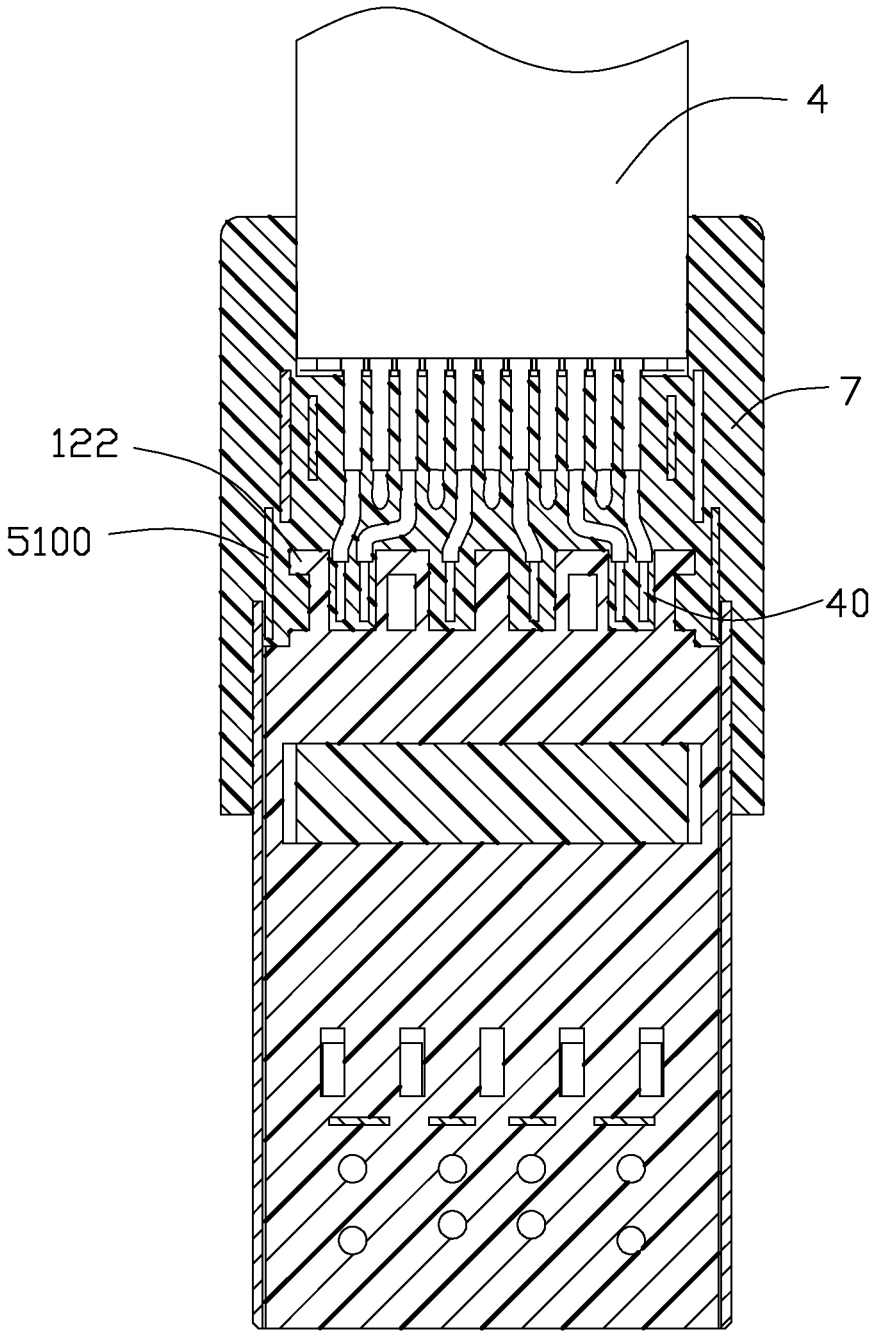
FIG. 7 is a cross-sectional view of the cable connector assembly taken along line 7-7 of FIG. 6.
Figure 8:
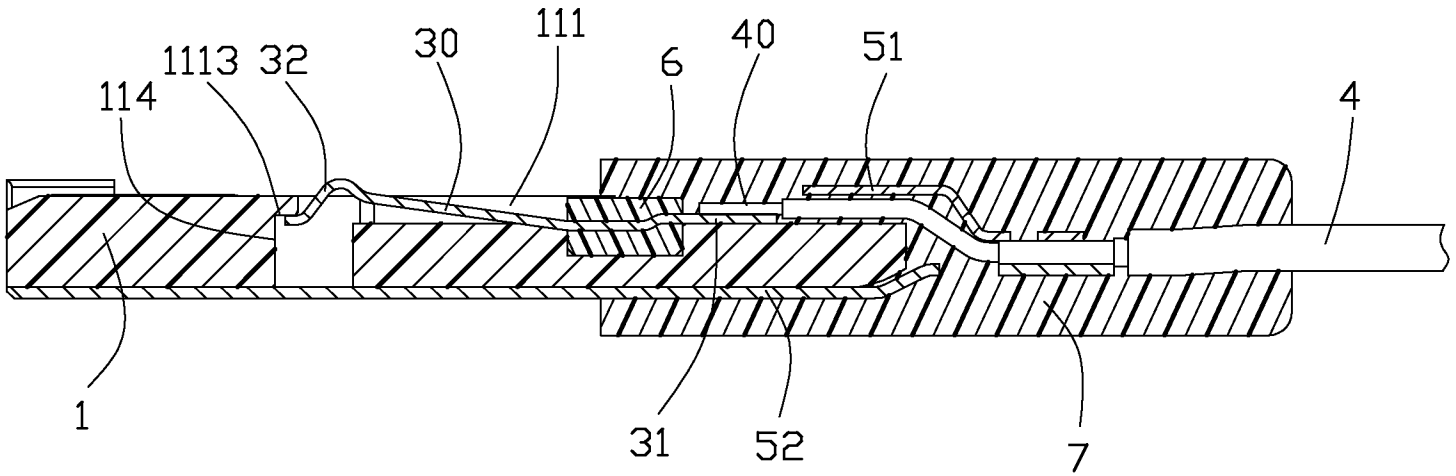
FIG. 8 is a cross-sectional view of the cable connector assembly taken along line 8-8 of FIG. 6.
Figure 9:
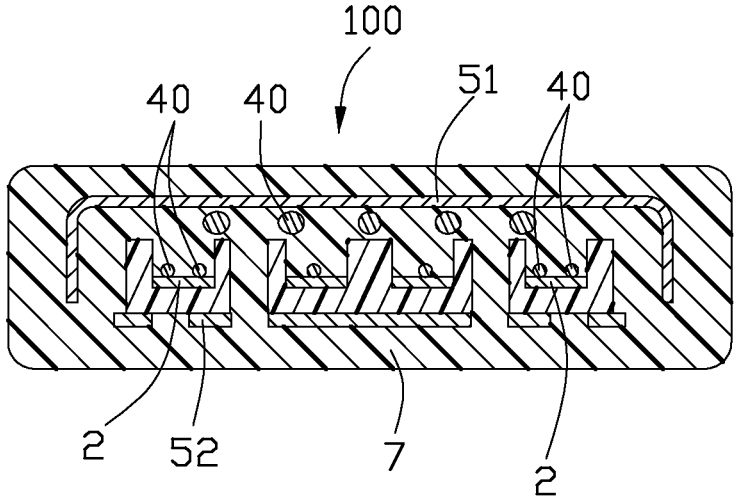
FIG. 9 is a cross-sectional view of the cable connector assembly taken along line 9-9 of FIG. 6.

The cable connector assembly comprises a flat-shaped cable 4 for connecting with the first contacts 2 and the second contacts 3. Because of the exist of the flat-shaped cable 4, the cable connector assembly 100 become low profile and meet with the requirement of the development of the cable connector assembly. And, as shown in FIG. 7, the two wires which are connected to the same one first contact 2 and spaced from each other with another wire therebetween transversely which is connected to a second contact 3.

What is claimed is:

1. A cable connector assembly, comprising:

a plurality of first contacts;

an insulative housing molding outside the first contacts;

a plurality of second contacts received in the housing;

a flat cable defining a plurality of wires formed therein, and connecting with the first contacts and the second contacts, and the plurality of wires comprising a plurality of inner conductors arranged on upper and lower row, the upper row of the inner conductors soldered to the second contacts and the lower row of the inner conductors soldered to the first contacts; and a metallic shell comprising a top shell and a bottom shell assembled with each other along a vertical direction, and shielding outside the insulative housing, the bottom shell only comprises a bottom wall and two side walls extending upwardly from two sides of the bottom wall respectively shielding bottom surface and side surfaces of the insulative housing, wherein the plurality of wires comprise a plurality braiding layers respectively enclosing the plurality of conductors, the bottom shell defines a supporting portion formed on a rear end thereof and soldered with the plurality of braiding layers, the top shell is engaged with the supporting portion of the bottom shell to sandwich the plurality of braiding layers of the wires therebetween.

2. The cable connector assembly as claimed in claim 1, wherein a plurality of terminal receiving grooves are formed in an upper surface of the insulative housing for receiving the second contacts.

3. The cable connector assembly as claimed in claim 1, wherein the insulative housing comprises a base portion and a tongue portion extending rearwardly from the base portion.

4. The cable connector assembly as claimed in claim 3, wherein a plurality of supporting grooves are formed in an upper surface of the tongue portion for supporting rear ends of the plurality of first contacts.

5. The cable connector assembly as claimed in claim 4, wherein each second contact comprises a base portion and a mating portion extending forwardly from the base portion.

6. The cable connector assembly as claimed in claim 2, wherein a groove is recessed downwardly from an upper surface of the insulative housing to divide the terminal receiving grooves into a front section and a back section.

7. The cable connector assembly as claimed in claim 6, wherein the cable connector assembly also comprises a spacer molding outside the second contacts and the spacer is disposed in the groove.

8. A cable connector assembly, comprising:

an insulative housing having a top surface, two side surfaces and a bottom surface thereof;

a plurality of first contacts and second contacts, each of the first contacts and the second contacts comprise a mating portion, and the mating portions of the first contacts and the second contacts are exposed on the upper surface of the insulative housing, and the mating portions of the first contacts disposed in the front of the mating portions of the second contacts;

a cable connecting with the first contacts and the second contacts, and the cable comprising a plurality of inner conductors arranged on the upper and lower row, the upper row of the inner conductors soldered to the second contacts and the lower row of the inner conductors soldered to the first contacts;

a metallic shell comprising a top shell and a bottom shell assembled to a rear portion of the bottom shell along a vertical direction, the bottom shell further comprising a shielding portion only having a bottom wall and two side walls respectively shielding the bottom surface and two side surfaces of the insulative housing;

wherein the cable is structured in a flat-shaped, and comprises a plurality of wires, the plurality of inner conductors are respectively formed in the corresponding wires, the plurality of wires comprise a plurality of braiding layers respectively enclosing the plurality of conductors and sandwiched between the top shell and the rear portion of the bottom shell, the plurality of braiding layers are soldered to the rear portion of the bottom shell.

9. An electrical connector comprising:

an insulative housing defining a mating tongue with a mating face thereon;

a plurality of first contacts disposed in the housing with non-deflectable contacting sections exposed upon the mating face, and first tail sections;

a plurality of second contacts disposed in the housing with deflectable contacting sections exposed upon the mating face, and second tail sections;

a plurality of wires located behind the housing, each of said wires defining an inner conductor, an inner insulative layer enclosing the inner conductor, a braiding layer enclosing the inner insulative layer, and an outer jacket enclosing the braiding layer;

wherein the wires and the corresponding second contacts keep a one-to-one connection relation while the wires and some of the corresponding first contacts keep a two-to-one connection relation;

further including a bottom shell assembled to the insulative housing, and defining a bottom wall and two side walls respectively shielding bottom surface and two side surfaces; and a top shell engaged with a rear portion of the bottom shell to sandwich a plurality of braiding layers of the wires, the rear portion of the bottom shell soldered to the plurality of braiding layers.

10. The electrical connector as claimed in claim 9, wherein the second contacts are unified with one another by an insulator which is assembled into a corresponding cavity of the housing in a vertical direction perpendicular to a front-to-back direction.

11. The electrical connector as claimed in claim 9, further including a metallic shell including a front portion covering a face of mating tongue opposite to said mating face, and a rear portion connecting to the braiding layers of the wires.

12. The electrical connector as claimed in claim 9, wherein remainder of the first contacts keeps the one-to-one connection relation with the corresponding wires.

13. The electrical connector as claimed in claim 9, wherein the two wires which are connected to the same one first contact, are spaced from each other with another wire therebetween transversely.

* * * * *